United States Patent [19]

Benoit et al.

[11] Patent Number: 4,672,823

[45] Date of Patent: Jun. 16, 1987

[54] DILUTION CRYOSTAT

[75] Inventors: Alain D. Benoit, Eybens; Serge Pujol, Poisat, both of France

[73] Assignee: Centre National de la Recherche Scientifique, Paris, France

[21] Appl. No.: 808,880

[22] Filed: Dec. 13, 1985

[30] Foreign Application Priority Data

Dec. 17, 1984 [FR] France ..... 84 19448

[51] Int. Cl.[4] ..... F25B 19/00

[52] U.S. Cl. ..... 62/514 R

[58] Field of Search ..... 62/514 R, 467

[56] References Cited

U.S. PATENT DOCUMENTS

| | | | |
|---|---|---|---|
| 4,277,949 | 7/1981 | Longsworth | 62/514 R |
| 4,296,609 | 10/1981 | Severijns et al. | 62/514 R |
| 4,297,856 | 11/1981 | Staas et al. | 62/514 R |
| 4,432,216 | 2/1984 | Matsuda et al. | 62/514 R |
| 4,459,828 | 7/1984 | Rosenbaum | 62/514 R |
| 4,499,737 | 2/1985 | Binnig et al. | 62/514 R |
| 4,548,053 | 10/1985 | Brown | 62/514 R |

FOREIGN PATENT DOCUMENTS

| | | |
|---|---|---|
| 15728 | 9/1980 | European Pat. Off. . |
| 2744346 | 4/1979 | Fed. Rep. of Germany . |

*Primary Examiner*—Ronald C. Capossela

*Attorney, Agent, or Firm*—Weingarten, Schurgin, Gagnebin & Hayes

[57] ABSTRACT

A $^3He$-$^4He$ dilution cryostat is provided in which a series of concentric dismountable enclosures permit ready disassembly for servicing and sample changing, and in which a secondary pumping circuit and a secondary cryogenic material delivery circuit provide rapid and convenient internal cooling of the dilution chamber by means of cooled cryogenic material, the dilution chamber being subsequently filled with the same cryogenic material in the liquified state. More particularly, the cryostat possesses a primary pumping circuit by which a $^3He$-$^4He$ mixture is forced through cooling elements to liquify it, transferred into the dilution chamber and an associated evaporator, and the $^3He$ finally recycled. A secondary pumping circuit includes a second evaporator connected to the dilution chamber, tubing connecting this evaporator with the tubing leading to the inlet side of a pump in the principal pumping circuit, and a valve located between the second evaporator and the tubing of the principal pumping circuit. A secondary cryogenic material delivery circuit includes heat exchanging elements connected in series between the pump of the principal pumping circuit and the tubing of the secondary pumping circuit, permitting cooled cryogenic material to be introduced into the first and second evaporators and the dilution chamber to cool them prior to filling them with liquified cryogenic material.

16 Claims, 1 Drawing Figure

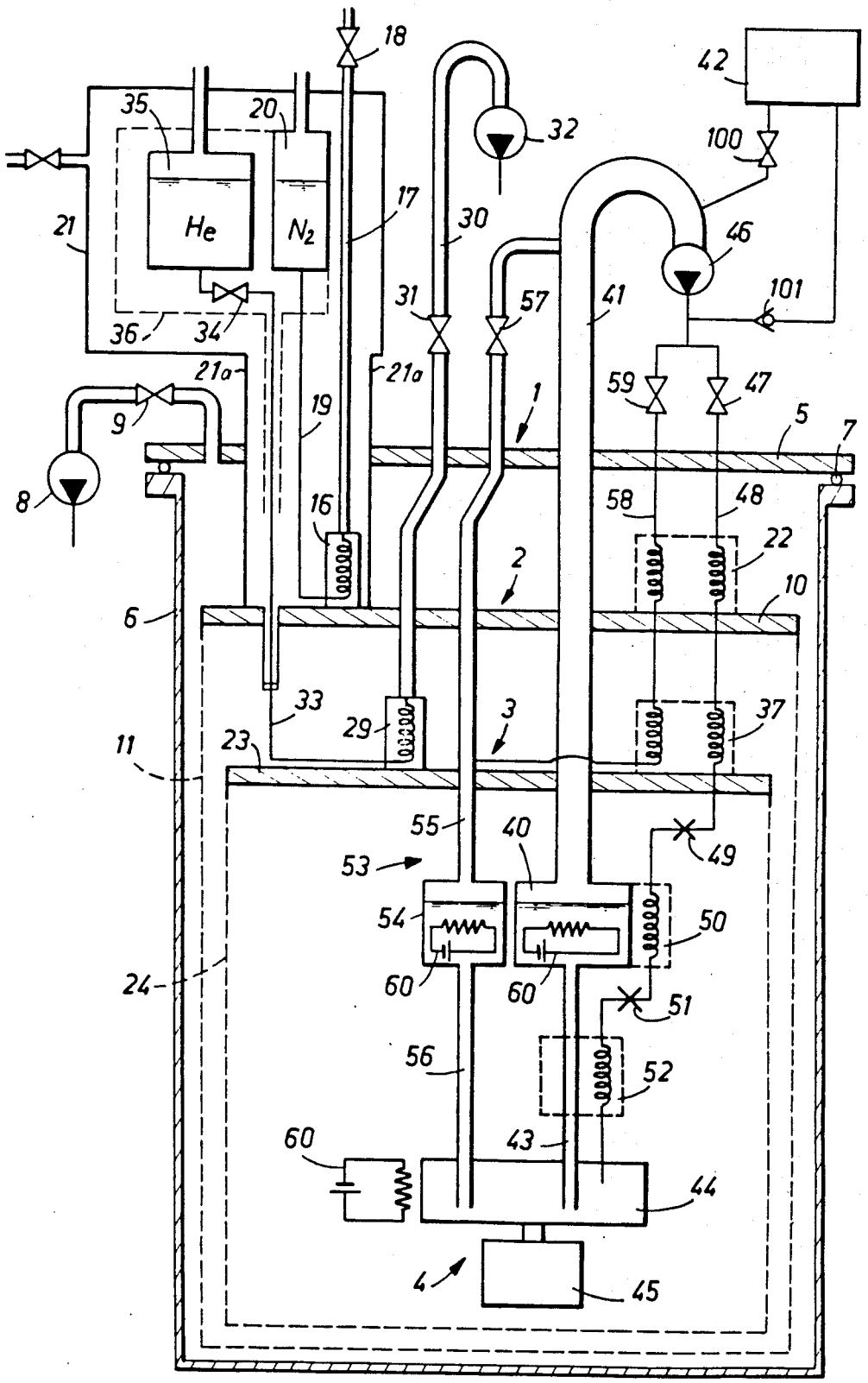
He
N2

DILUTION CRYOSTAT

The present invention relates to dilution cryostats, i.e. to apparatus or installations enabling very low temperatures, of the order of 1° Kelvin, to be attained.

The invention relates to apparatus of the above type which may be used in the laboratory for research purposes, or for industrial purposes, for example for analyzing the physical properties of various materials or, more particularly, of super-conductive materials.

The invention relates more especially to apparatus or installations enabling very low temperatures, less than 1° Kelvin, to be attained.

Dilution cryostats may be classified in two categories.

The first concerns apparatus or installations in which the sample to be analyzed is fixed on the cold point. As a general rule, this cold point is constituted by a wall of the dilution chamber which is disposed in a tight enclosure. The working principle of these cryostats consists in introducing helium in gaseous phase into the tight enclosure in order to effect a pre-cooling prior to the subsequent operating mode in dilution.

Using an apparatus of the above type is time consuming, given that, for each sample, it is necessary to open the enclosure, fit the sample, close the enclosure, introduce helium gas to ensure pre-cooling of the dilution chamber to about 4° Kelvin, then pump this gas out completely before engaging the dilution mode operation of the cryogenic mixture.

Such a type of apparatus is not applicable on an industrial scale, in view of the long, even delicate manipulations to be made in order to allow assembly and dismantling of a sample to be treated, and in view of the duration of use.

The second category concerns dilution apparatus comprising, with a view to overcoming the above drawbacks, a sample changer placed in relation with the cold point. However, the existence of a sample changer, although it facilitates changing, does not solve the problem of pre-cooling ensured by the exchange gas in gaseous phase in the enclosure surrounding the dilution chamber.

It is an object of the present invention to overcome the above drawbacks by proposing a novel dilution cryostat designed to allow rapid operation, solely from the elements constituting said apparatus or installation, as well as rapid access for changing the sample.

In order to attain the above objects, the dilution cryostat of the invention is characterized in that it comprises:

(a) a secondary pumping circuit including an evaporator and a valve placed between the dilution chamber and the circulation pump forming part of the main pumping and delivery circuit, and (b) a secondary delivery circuit controlled beyond the pump by an inlet valve, passing through the first and second pre-cooling stages and terminating in the secondary pumping circuit downstream of the evaporator with respect to the dilution chamber.

The invention will be more readily understood on reading the following description with reference to the accompanying drawings, in which:

The single FIGURE is a schematic view illustrating the structure of the dilution cryostat according to the invention.

Referring now to the drawing, the dilution cryostat according to the invention comprises a suspension framework 1 from which is suspended a first pre-cooling stage 2, beneath which is fixed a second pre-cooling stage 3 associated in turn with a suspended dilution unit 4.

The framework 1 principally comprises a plate 5 beneath which is fitted a tight enclosure 6 via a dismountable seal 7.

The assembly makes it possible to insulate the inner volume which may be placed in vacuo with the aid of pump 8 and valve 9.

The first pre-cooling stage 2 comprises a heat exchange plate 10 made of a metal having very good heat conductivity, for example copper. The plate 10 is suspended from plate 5 by the pumping tubes which are described hereinafter and have a low heat conductivity.

Extending downwardly from plate 10 is a dismountable enclosure 11 with closed bottom. This enclosure, made of a conducting material such as copper or aluminium, is not tight and serves solely as barrier against heat radiations.

The first pre-cooling stage 2 further includes an evaporator 16 borne by the exchange plate 10. Evaporator 16 is connected to an evacuation conduit 17 controlled by a valve 18. Evaporator 16 is also connected at its input by a pipe 19 to a reservoir 20 of a cryogenic liquid such as liquid nitrogen. Reservoir 20 is enclosed in a tight compartment 21. Reservoir 20 is placed under pressure with respect to evaporator 16. The pipe 17 evacuates the vaporized nitrogen to the open air.

Furthermore, pre-cooling plate 10 supports an exchanger-condenser 22 with two independent circuits, operation of which will be described hereinafter.

The second pre-cooling stage 3 comprises a heat exchange plate 23 which is suspended from plate 10 by the pumping and circulation tubes described hereinafter and having a low heat conductivity. Plate 23 is made of a very good heat-conducting metal, for example copper. Extending downwardly from plate 23 is a dismountable enclosure 24, with closed bottom. This enclosure, made of a conducting material such as copper or aluminium, is not tight and serves solely as barrier against heat radiations.

Plate 23 supports an evaporator 29 comprising a delivery pipe 30 passing through plate 10 and plate 5 and further comprising, outside the latter, a valve 31 placed upstream of an extraction pump 32. Evaporator 29 is connected, by a pipe 33 including a valve 34, to a reservoir 35 containing a cryogenic product, such as liquid helium. The reservoir 35 is enclosed in the tight compartment 21. A screen 36, connected to the liquid nitrogen reservoir 20, protects it from heat radiations.

Pipes 17, 19 and 33 pass through plate via a heat insulating sheath 21*a* formed by compartment 21.

Plate 23 also supports an exchanger-condenser 37 with two independent internal circuits, operation of which will be described hereinafter.

The dilution unit 4 comprises, according to the invention, a principal evaporator-distiller 40, suspended from plate 23 by a principal pumping circuit 41 rising vertically and passing through plates 10 and 5 successively. The principal evaporator-distiller 40 is connected at its base by a pipe 43 to a dilution chamber 44 constituting the cold point of the dilution unit 4. The dilution chamber 44 is shaped so that its bottom represents a support for fixing a sample 45 to be analyzed.

The principal pumping circuit 41 comprises a pump 46 the outlet of which is connected, by a valve 47, to a principal delivery circuit 48 constituted by a pipe of small cross-section passing through the exchanger-condensers 22 and 37. The circuit 48 comprises, beyond the exchanger-condenser 37, an expansion restrictor 49 beyond which it passes through an exchanger 50 placed in relation with the principal evaporator-distiller 40. At the outlet of the exchanger 50, the circuit 48 further comprises a second expansion restrictor 51 beyond which it passes through an exchanger 52 surrounding tube 43 concentrically. Circuit 48 then opens out in the upper part of the dilution chamber 44.

The dilution cryostat further comprises a secondary pumping circuit 53 comprising an evaporator-distiller 54 suspended from plate 23 by a column 55 likewise passing through plates 10 and 5. Column 55 is controlled by a valve 57 beyond which it is connected to the principal circuit 41. The evaporator 54 is connected, by a pipe 56, to the dilution chamber 44.

The dilution cryostat further comprises a secondary delivery circuit 58 also connected to the outlet of the pump 46, by a valve 59. The circuit 58 passes through the exchanger-condenser 22, then through the exchanger-condenser 37 beyond which it is connected to column 55 in that part of the latter located above the plate 23 of the second pre-cooling stage 3.

Outside the cryostat is located a reserve 42 containing the quantities of the $^3He$ and $^4He$ necessary for operation and mixed in gaseous form. A valve 100 enables the reserve to be emptied with the aid of pump 46, a valve 101 allowing the return of the $^3He/^4He$ mixture into the reserve at the end of use.

The above-described structure presents the advantage of allowing easy positioning and removal of the sample 45. In fact, for all these operations, it suffices to establish normal pressure in enclosure 6 by valve 9, then to dismantle enclosures 6, 11 and 24 successively.

For this advantage of accessibility to be effectively practical, the structure of the cryostat is also chosen for the apparatus to operate effectively rapidly. In other words, the structure of the apparatus is chosen so that the prior pre-cooling phase is effected more simply and more rapidly than in accordance with the prior known technique.

In fact, according to the invention, after fitting of a sample 45 and assembly of the different enclosures 24, 11 and 6, a pumping and evacuation operation may occur simultaneously with a pre-cooling process which is carried out in the following manner.

Valve 18 is opened so that the liquid nitrogen passes by gravity into evaporator 16, with a view to ensuring cooling of plate 10. At the same time, valves 31 and 34 are opened and pump 32 is set into operation, so as to create a circulation of helium in the evaporator 29 charged with cooling the heat exchange plate 23.

Valve 57 is then closed, as is valve 47, while valve 59 is, on the contrary, opened. Pump 46 is set into operation so as to deliver cryogenic mixture extracted from reserve 42 into the secondary delivery circuit 58. The cryogenic mixture in gaseous phase is cooled by passing through the exchanger-condenser 22, then the exchanger-condenser 37, before being introduced into column 55 where it arrives at low temperature. The cold mixture then follows pipe 56, passes through dilution chamber 44 and rises by the principal pumping circuit 41, before being recycled by pump 46.

This circulation has for its effect to cool the dilution unit by internal circulation, while the dilution cryostats of known type ensure a pre-cooling phase by outside circulation of a cryogenic product in vapour phase, such as helium.

When the lowest temperature is attained by the circulation process described hereinabove, for example in the vicinity of 4° Kelvin, valves 47 and 57 are opened, while valve 59 is closed.

Pump 46 then delivers cryogenic mixture into the principal delivery circuit 48. After having cooled in exchanger 22, the mixture is condensed in exchanger-condenser 37, before expanding through the restrictors 49 and 51. The liquid thus obtained is accumulated in the lower parts of the apparatus until chamber 44 is completely filled, then tube 56 and exchanger 52 are filled, and finally, the liquid partially fills evaporators 40 and 54, where the levels balance out.

At that moment, reserve 42 being empty, distillation of the mixture in the two evaporators commences. The $He^4$ fraction remains at the bottom of the cryostat and the $He^3$ fraction is pumped off by pump 46. The pure $He^3$ fraction thus obtained is then delivered to principal delivery circuit 48 by valve 47, cooled in exchanger 22, condensed in exchanger 37, expanded in 49, cooled in 50, expanded in 51 and, finally, cooled in exchanger 52, before being diluted in the $He^4$ fraction contained in the dilution chamber 44, thus cooling the sample. The $He^3$ fraction rises towards the two evaporators, diffusing in the $He^4$ fraction, cooling exchanger 52 on passing and preventing any heat from descending along tubes 56 and 43.

The structure of the dilution cryostat according to the invention thus makes it possible, by using the same cryogenic mixture, to ensure a pre-cooling by circulation of the mixture in gaseous phase inside the elements constituting the dilution unit 4, then to maintain operation in dilution mode by circulation of the same mixture in liquid phase, the transition from one mode of operation to the other being effected by controlling valves 47, 59 and 57. It thus becomes possible to use such an apparatus rapidly and thus to benefit optimally from the advantages of rapid sample-change due to the structure of the dismountable concentric enclosures 6, 11 and 24. It also becomes possible to apply to the sample 45 all the desired ranges of temperature, being given that the latter depends solely on the mode of circulation and not on the temperature of the reserves of cryogenic liquid 20 and 35.

Since that the phases of pre-cooling and of cooling occur by internal circulation, it becomes possible to change the sample 45 rapidly. In fact, it suffices to re-establish the pressure and ambient temperature inside the enclosure 24 to allow the enclosures to be dismantled. To this end, it suffices to provoke vaporization of the liquid phase of the cryogenic mixture occupying the evaporators 40 and 54 and the dilution chamber 44. To that end, these three component elements are associated with electrical resistors 60.

It should also be noted that the reserves of cryogenic liquid, necessary for pre-cooling via the plates 10 and 23, are totally independent of enclosures 6, 11 and 24 and of dilution unit 44 which may therefore be rapidly reheated to ambient temperature during the phase of change of a sample 45.

The invention is not limited to the embodiment described and shown, as various modifications may be made thereto without departing from its scope.

What is claimed is:

1. A dilution cryostat, comprising:

a dilution chamber;

a principal evaporator located above said dilution chamber and having an inlet and an outlet, the inlet of said principal evaporator being connected to said dilution chamber by tubing;

a principal pumping circuit, further comprising:

a pump having an inlet and an outlet; and tubing connecting the outlet of said principal evaporator and the inlet of said pump;

a principal cryogenic media delivery circuit, further comprising:

means for liquifying cryogenic gas and delivering the resulting liquid to said dilution chamber;

a secondary pumping circuit, further comprising:

a secondary evaporator located above said dilution chamber and having an inlet and an outlet, the inlet of said secondary evaporator being connected to said dilution chamber by tubing;

tubing connecting the outlet of said secondary evaporator to the tubing of said principal pumping circuit;

a valve, located in said secondary pumping circuit tubing, between said secondary evaporator and the tubing of said principal pumping circuit;

a secondary cryogenic media delivery circuit, further comprising:

means for cooling cryogenic gas and delivering the resulting cooled gas to the tubing of said secondary pumping circuit, between said secondary evaporator and the valve of said secondary pumping circuit;

valve means, connecting the outlet of said pump with the principal and the secondary cryogenic media delivery circuits, for directing the output of said pump to either said principal delivery circuit or said secondary delivery circuit;

an inner container enclosing said dilution chamber and said principal and secondary evaporators;

means for cooling said inner container;

a second container, enclosing said inner container; and means for cooling said second container.

2. The cryostat of claim 1 wherein:

said second container further comprises:

a first heat exchanger plate; and a first enclosure adapted for dismountable attachment to said first heat exchanger plate; and said inner container further comprises:

a second heat exchanger plate; and a second enclosure adapted for dismountable attachment to said second heat exchanger plate.

3. The cryostat of claim 2 wherein said inner container is suspended from said first heat exchanger plate.

4. The cryostat of claim 3 further comprising an outer container enclosing said second container.

5. The cryostat of claim 4 wherein said outer container is vacuum tight and further comprises means for evacuation of said outer container.

6. The cryostat of claim 4 wherein said outer container further comprises:

a primary supporting plate; and an outer enclosure adapted for dismountable attachment to said primary supporting plate.

7. The cryostat of claim 6 wherein said second container is suspended from said primary supporting plate.

8. The cryostat of claim 2 wherein said means for cooling said inner container further comprise:

a third evaporator, located on said second heat exchange plate and having an inlet and an outlet;

a source of coolant, connected to the inlet of said third evaporator; and a source of vacuum, connected to the outlet of said third evaporator.

9. The cryostat of claim 8 wherein said coolant is liquid helium.

10. The cryostat of claim 8 wherein said source of vacuum is a pump.

11. The cryostat of claim 2 wherein said means for cooling said second container further comprise:

a fourth evaporator, located on said first heat exchange plate and having an inlet and an outlet;

a source of coolant, connected to the inlet of said fourth evaporator; and a vent to the atmosphere, connected to the outlet of said fourth evaporator.

12. The cryostat of claim 11 wherein said coolant is liquid nitrogen.

13. The cryostay of claim 1 wherein said means for cooling and delivering cryogenic gas comprise:

first and second heat exchangers connected in series, said first heat exchanger being connected to said valve means, said second heat exchanger being connected to the tubing of said secondary pumping circuit, and means for removing heat from said first and second heat exchangers.

14. The cryostat of claim 1 wherein said means for liquifying cryogenic gas comprise:

first and second condensers connected in series, said first condenser being connected to said valve means;

a first expansion-restrictor, connected in series with said second condenser;

a third condenser, connected in series with said first expansion-restrictor;

a second expansion-restrictor, connected in series with said third condenser; and a fourth condenser, connected in series with said second expansion-restrictor, and further connected to said dilution chamber; and means for removing heat from said first, second, third, and fourth condensers.

15. The cryostat of claim 1 wherein said principal evaporator and said secondary evaporator are at substantially the same level.

16. The cryostat of claim 1 wherein said cryogenic gas is a $^3He$-$^4He$ mixture.

* * * * *

UNITED STATES PATENT AND TRADEMARK OFFICE

CERTIFICATE OF CORRECTION

PATENT NO. : 4,672,823

DATED : June 16, 1987

INVENTOR(S) : Alain D. Benoit; Serge Pujol

It is certified that error appears in the above-identified patent and that said Letters Patent is hereby corrected as shown below:

| | | |
|---|---|---|
| Column 2, | line 39, | "having a low" should read --having low-- |
| | line 55, | "plate via" should read --plate 5 via-- |
| Column 4, | line 21, | "$He^4$ fraction" should read --$^4$He fraction-- |
| | line 22, | "$He^3$ fraction" should read --$^3$He fraction-- |
| | line 23, | "$He^3$ fraction" should read --$^3$He fraction-- |
| | line 27, | "$He^4$ fraction" should read --$^4$He fraction-- |
| | line 28, | "$He^3$" should read --$^3$He-- |
| | line 30, | "$He^4$ fraction," should read --$^4$He fraction-- |
| | line 50, | "Since that the" should read --Since the-- |
| Column 6, | line 30, | "The cryostay" should read --The cryostat-- |

Signed and Sealed this

First Day of November, 1988

*Attest:*

DONALD J. QUIGG

*Attesting Officer*

*Commissioner of Patents and Trademarks*